US011116289B1

(12) United States Patent
Chan

(10) Patent No.: US 11,116,289 B1
(45) Date of Patent: Sep. 14, 2021

(54) SLIDING CONNECTOR ASSEMBLY

(71) Applicant: Duraflex Hong Kong Limited, Hong Kong (CN)

(72) Inventor: Man Chak Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 17/095,014

(22) Filed: Nov. 11, 2020

(51) Int. Cl.
*A44B 11/25* (2006.01)
*A44B 19/30* (2006.01)

(52) U.S. Cl.
CPC ..... *A44B 11/2596* (2013.01); *A44B 19/30* (2013.01)

(58) Field of Classification Search
CPC ..... A44B 11/2596; A44B 11/2584
See application file for complete search history.

(56) References Cited

U.S. PATENT DOCUMENTS 796,414 A * 8/1905 Chayes ..... A41F 3/02 24/319
3,979,801 A * 9/1976 Tareau ..... A41F 1/006 24/587.12
4,502,191 A * 3/1985 Savage ..... A44B 11/2596 24/587.12
4,578,843 A * 4/1986 Lewis ..... A44B 11/2596 24/319
7,480,967 B2 * 1/2009 Kojoori ..... A44B 11/006 2/322
8,857,019 B1 * 10/2014 Nykoluk ..... A44B 11/263 24/587.12
9,578,911 B2 * 2/2017 Fildan ..... A44B 11/2596

FOREIGN PATENT DOCUMENTS

CN 208550206 U 3/2019

* cited by examiner

*Primary Examiner* — Robert Sandy
(74) *Attorney, Agent, or Firm* — Collard & Roe, P.C.

(57) ABSTRACT

A connector assembly is formed from a female portion, a male portion and a locking cover. The female portion has a longitudinal channel with an opening and a slot that extends into the channel. The male portion has a locking post and an indentation that aligns with the slot when the post is inserted into the channel. The locking cover has a locking tooth that extends through the slot and into the channel. The male portion is connected to the female portion by sliding the locking post into the channel until the indentation aligns with the slot, so that the locking tooth rests in the indentation. The male portion is released from the female portion by pulling the locking cover away from the female portion until the locking tooth clears the indentation in the post which is mounted in the channel, and sliding the male portion and female portion away from each other.

9 Claims, 4 Drawing Sheets

SLIDING CONNECTOR ASSEMBLY

BACKGROUND OF THE INVENTION

1. Field of the Invention

This invention relates to a connector assembly that can connect a fabric article with a length of webbing. In particular, the invention relates to a connector whose parts can be engaged and disengaged quickly and easily, yet maintains a secure connection during use.

2. The Prior Art

A connector of this type is disclosed in Chinese Utility Model CN208550206U. This connector is formed of a male part having a tab and a locking post, and a female part having a tab and a locking channel. The post of the male part slides into the locking channel of the female part to connect the two parts together. The tabs on each part can be permanently connected, such as by sewing to two different articles. A locking pawl at an end of the post of the male part engages a wall outside the channel of the female part to connect the two parts together. Slots in the locking channel cooperate with protrusions in the post on the opposite end to prevent the male part from extending further into the channel. A sufficient force in the sliding direction is required in order to move the male part out of engagement with the female part.

While this type of connector is useful, it would be desirable to construct a connector system that is even more secure, to prevent inadvertent disengagement, even under force in the sliding direction.

SUMMARY OF THE INVENTION

It is therefore an object of the invention to provide a connector assembly that is simple to operate yet is secure enough to prevent inadvertent disengagement, even under force in any direction.

This and other objects are accomplished according to the invention by a connector assembly formed by a female portion, a male portion and a locking cover. The female portion has a base body having a longitudinal channel with an opening along one side of the base body. The longitudinal channel has a width that is greater than a width of the opening. The base body has at least one slot that extends through to the longitudinal channel in an area remote from the opening. The male portion has a locking post extending along one longitudinal edge. The locking post has a width that is greater than a width of the opening in the channel and has at least one indentation that aligns with the slot when the post is inserted into the channel. Connected to the locking post is a portion that can be connected to an article. The locking cover is connected to the female portion and has an underside that surrounds an outer surface of the base body of the female portion. The locking cover has at least one locking tooth that extends through the at least one slot and into the channel.

The male portion is connected to the female portion by sliding the locking post into the channel until the at least one indentation aligns with the slot, at which point the at least one locking tooth of the locking cover rests in the at least one indentation to prevent movement of the post in the channel. The male portion is released from the female portion by pulling the locking cover away from the female portion until the at least one locking tooth clears the at least one indentation in the post of the male portion mounted in the channel of the female portion, and sliding the post out of the channel to separate the male portion and female portion. In the present invention, the locking features are hidden underneath the locking cover so, they cannot be inadvertently activated if the buckle assembly is externally contacted. The only way to disengage the two parts is by lifting the front end of the locking cover while simultaneously sliding the male and female parts away from each other Preferably, there are two locking teeth in the locking cover, two slots in the female portion, and two indentations in the post, which lends greater stability to the assembly. Alternatively, a single large slot and indentation could accommodate both locking teeth of the cover.

The two portions can be used to attach a length of webbing to a cloth article. In this embodiment, the male portion has an attachment tab configured for being sewn to an article and the female portion has an attachment bar configured for attachment to a length of webbing.

In one embodiment, the locking cover is U-shaped and has a front wall, a top wall and a rear wall, with the locking teeth attached to an interior surface of the front wall. The female portion has a plurality of studs on a top side and a rear side, and the locking cover has a plurality of sockets extending through the top wall and rear wall. The locking cover is connected to the female portion by snapping the studs into the sockets. The front wall of the locking cover is not attached to the female portion and is free to move in order to disengage the locking teeth from the indentations in the post of the male portion.

To enable simple assembly of the parts, the male portion is configured to be snapped into the female portion without having to lift the locking cover. To accomplish this, the front end of the post is rounded so that when the post is inserted into the channel, the at least one locking tooth slides up the rounded end and is raised up and away from the post to allow the post to be fully inserted into the channel. Once the post is fully inserted, the locking teeth extend through the slots into the channel to lock the male portion to the female portion.

To keep the post from sliding past a full insertion position, a rear end of the post has a flange that is wider than the channel, and a corresponding end of the female portion has a cutout extending into the channel. When the post is fully inserted into the channel, the flange is seated in the cutout and prevents further insertion of the post into the channel.

To assist the user in lifting the locking cover to release the male and female portions, the locking cover has a ledge on the front wall that forms a lifting surface for a finger to lift the front wall up and away from the female portion and post of the male portion, which is inserted in the channel of the female portion. The ledge can be grooved or textured to prevent the user's finger from slipping as the locking cover is being lifted.

So that the locking cover can be lifted and lowered more easily and without breakage, the locking cover is formed at least partially from a flexible material, such as a soft plastic, or can have weakened points that allow for bending of the material of the locking cover.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 2:
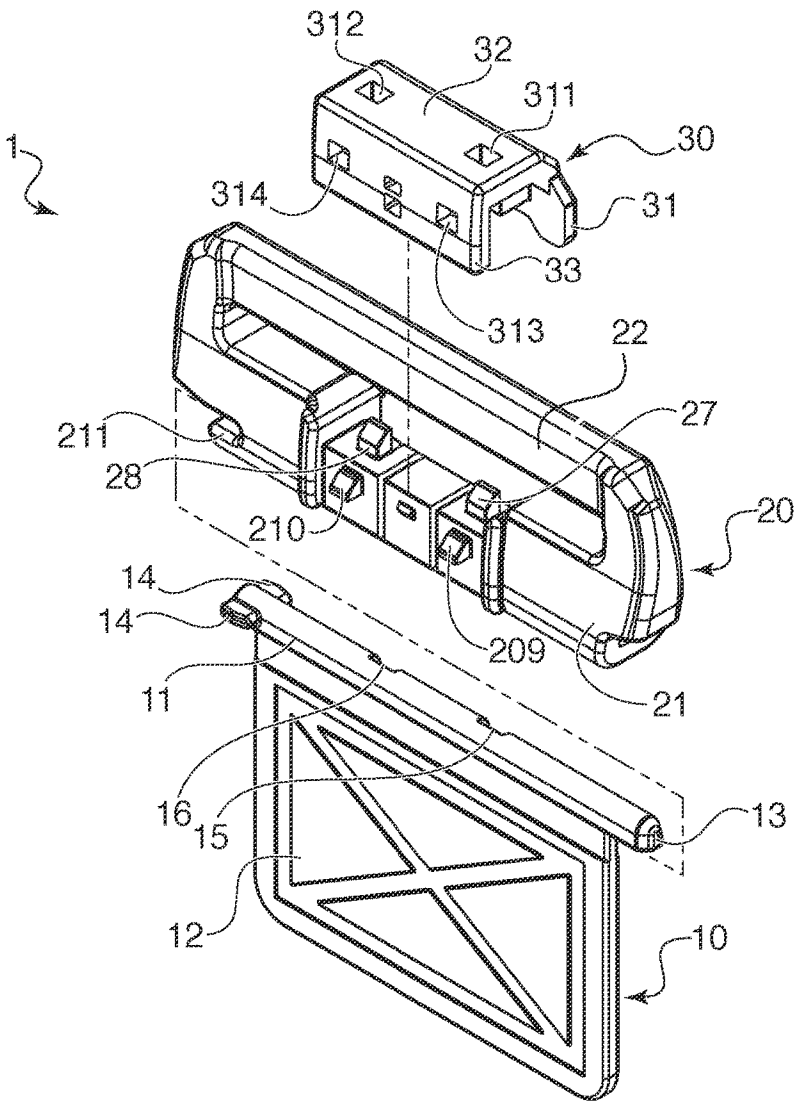
FIG. 2 shows an exploded view of a rear side of the connector assembly.
Figure 1:
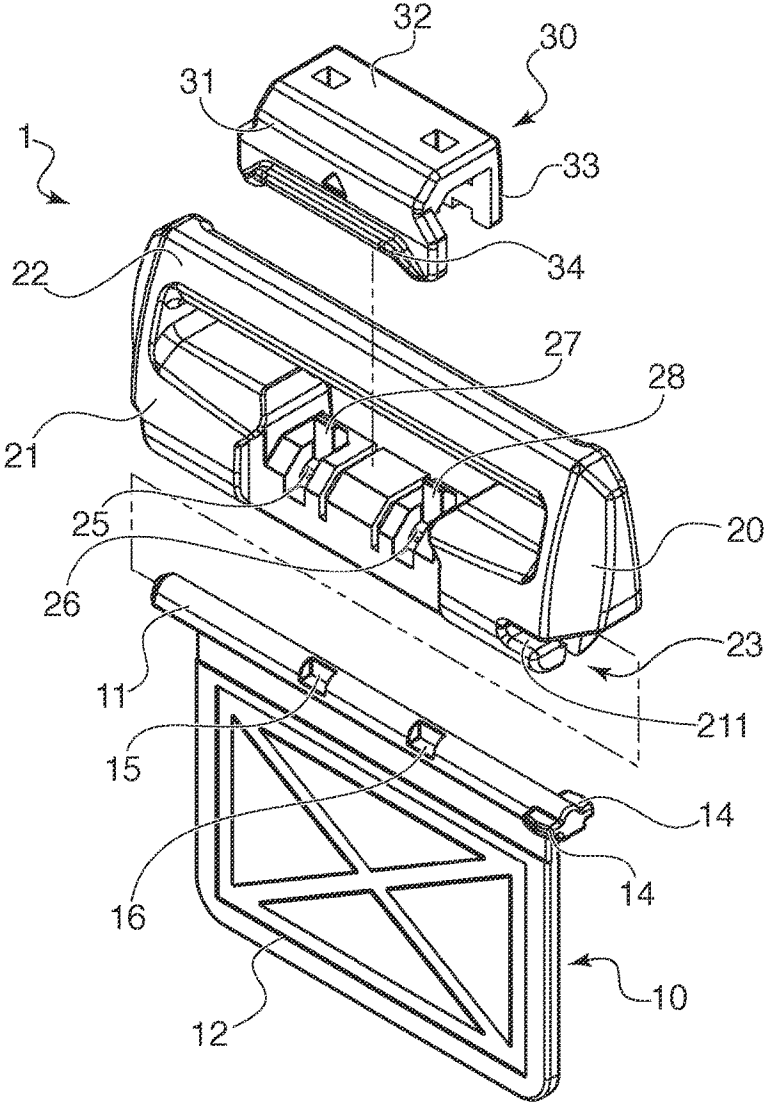
FIG. 1 shows an exploded view of a front side of the connector assembly according to the invention.

Referring now in detail to the drawings, FIGS. 1 and 2 show an exploded view of the connector assembly 1, which is formed from a male portion 10, a female portion 20 and a locking cover 30. Male portion 10 has a post 11 connected to a sewable flap 12, which can be sewn directly to a fabric article. Post 11 has a rounded front end 13, two stop flanges 14 at a rear end, and two locking indentations 15, 16 disposed along its top surface.

Figure 3:
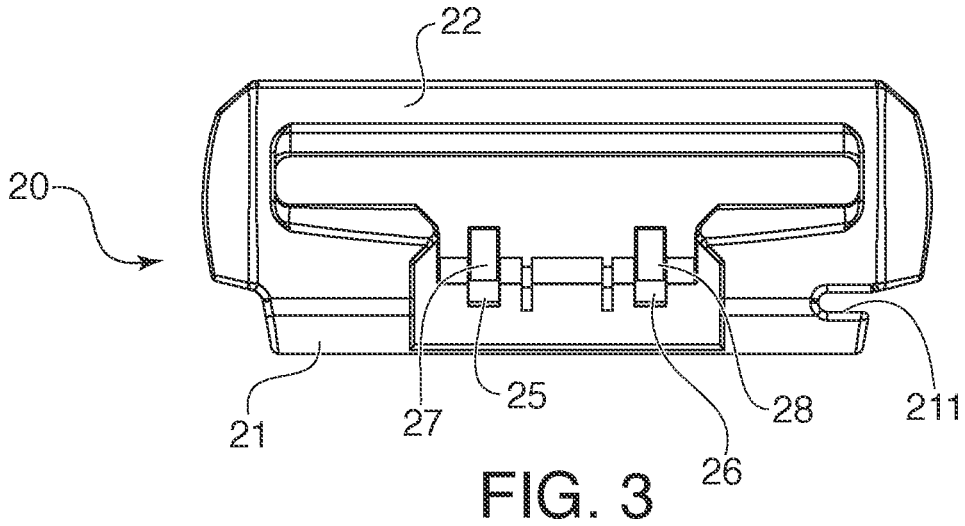
FIG. 3 shows a front view of the female portion.
Figure 4:
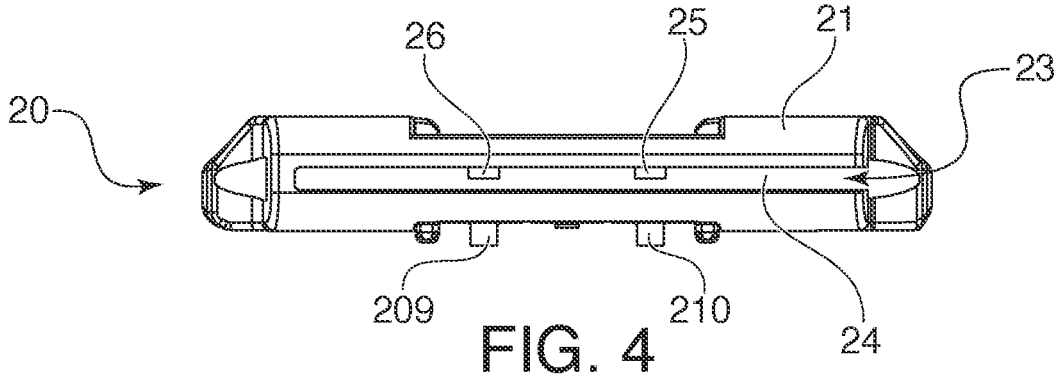
FIG. 4 shows a bottom view of the female portion.
Figure 5:
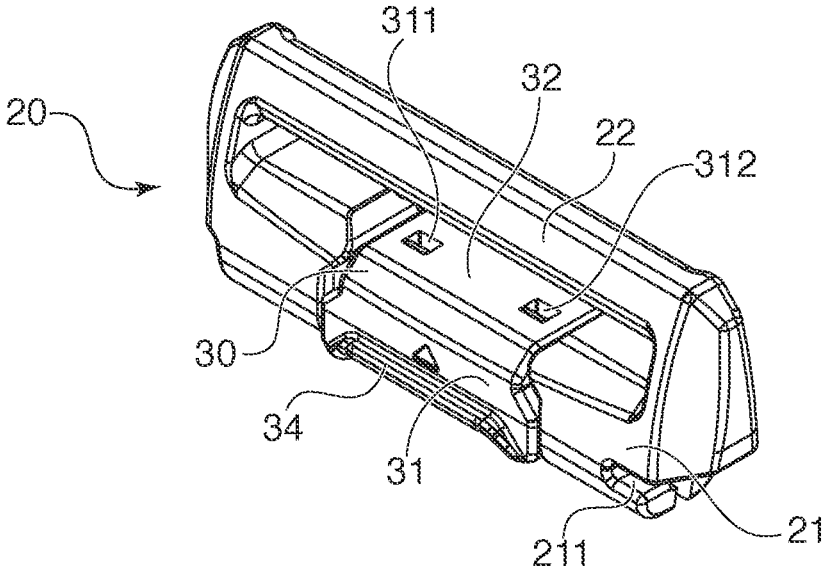
FIG. 5 shows a perspective view of the female portion with the locking cover installed thereon.

Female portion 20, which is shown in detail in FIGS. 3-5, has a base body 21 connected to a strap retaining bar 22. A channel 23 runs through base body 21 and has a longitudinal opening 24 (seen in FIG. 4), which has a width that is smaller than a width of the channel 23 (seen in FIGS. 10-12). Base body 21 has two slots 25, 26 that extend into channel 23, as seen in FIGS. 1 and 4.

Figure 6:
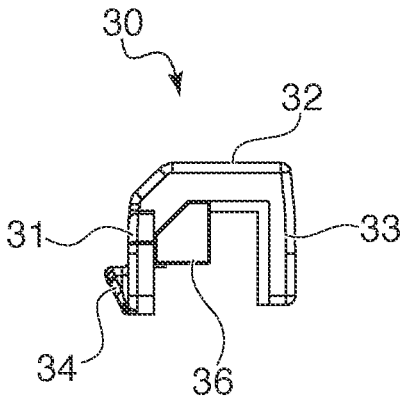
FIG. 6 shows a side view of the locking cover.
Figure 7:
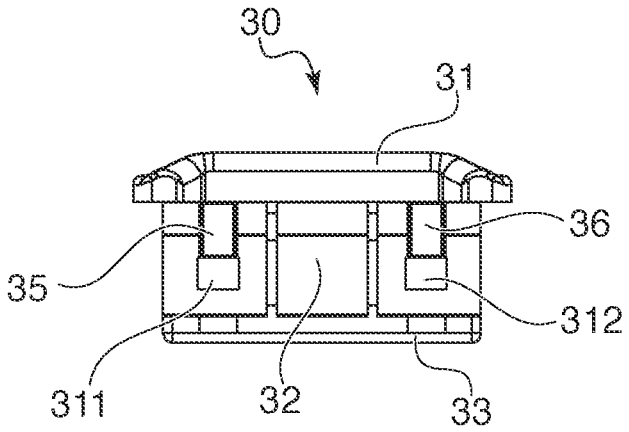
FIG. 7 shows a bottom view of the locking cover.

A locking cover 30, which is shown in detail in FIGS. 6 and 7, is configured to be attached to female portion 20. Locking cover 30 has a front wall 31, a top wall 32 and a rear wall 33. Two locking teeth 35, 36 are disposed on the inside of front wall 31. Locking cover 30 is attached to female portion 20 by snapping protrusions 27, 28 of female portion 20 into sockets 311, 312 on top wall 32 of cover 30, as well as snapping protrusions 209, 210 on the rear of base body 21 into protrusions 313, 314 on the back wall 33 of cover 30. Locking cover 30 is not connected to female portion 20 along its front wall 31. A portion of locking cover 30, preferably along the top and/or front walls, is formed to be of a flexible material, or the overall material of cover 30 is weakened, so that front wall 31 is able to be lifted up and away from female portion 20 by a user pushing upward on the bottom edge of front wall 31. Alternatively, the entire cover 30 can be formed of a flexible material. Cover 30 can be made from a different material from the male and female portions. Preferably, all of the components of the connector assembly are formed of plastic materials. Front wall 31 can be equipped with a ledge 34, to assist a user's finger to push front wall up and away from female portion 20 and out of engagement with post 11 of male portion 10 which is mounted therein.

Figure 8:
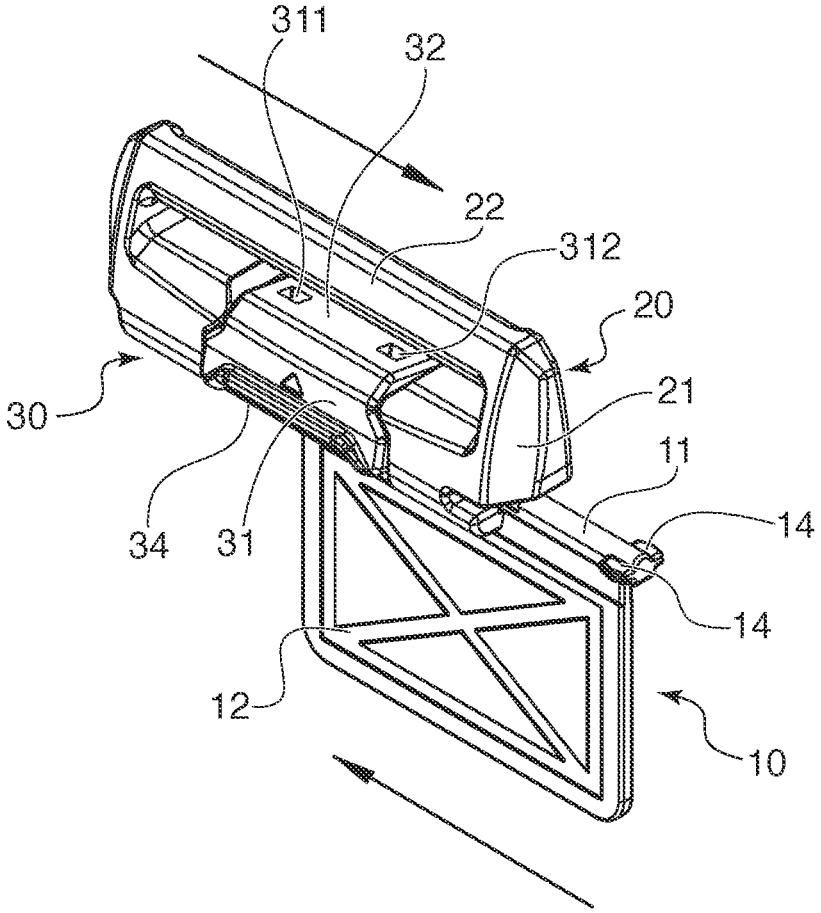
FIG. 8 shows the female portion and male portion moving in a locking direction along the arrows.
Figure 9:
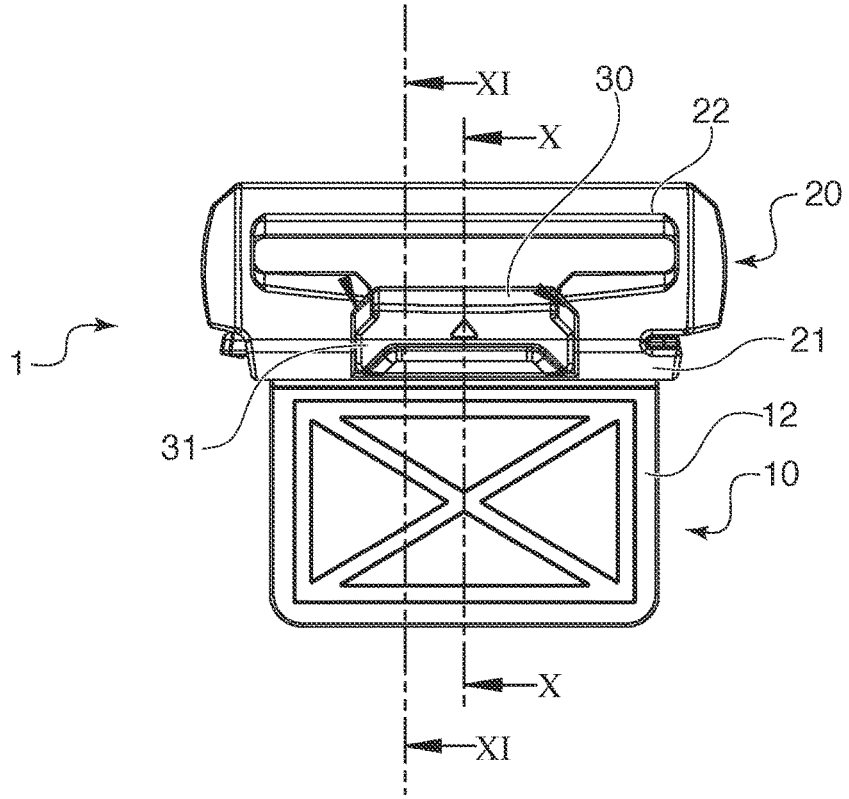
FIG. 9 shows a front view of the connector assembly.

The connection of male portion 10 and female portion 20 is as follows, with reference to the parts shown in FIGS. 1 and 2: First, cover 30 is snapped onto female portion 20 by snapping protrusions 27, 28, 209 and 210 into sockets 311, 312, 313 and 314. After this assembly, locking teeth 35, 36, extend through slots 25, 26 of female portion 20 and into channel 23 (seen FIG. 11). Next, front end 13 of post 11 is inserted into channel 23 of female portion 20 and the parts are slid together along the arrows shown in FIG. 8. During the connection process, front end 13 pushes against locking teeth 35, 36 of cover 30 and forces them upward to allow post 11 to pass through channel 23. Once post 11 is fully inserted, locking teeth 35, 36 come to rest in indentations 15, 16 of post 11, and further sliding movement of post 11 relative to female portion 20 is prevented. Once post 11 is fully inserted, flanges 14 rest in cutouts 211 to prevent further horizontal movement of post 11. The fully assembled connector assembly is shown in FIG. 9.

Figure 10:
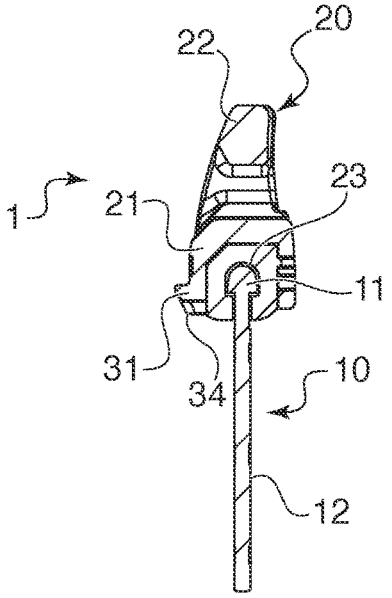
FIG. 10 shows a side cross-sectional view of the connector assembly along lines X-X of FIG. 9.
Figure 11:
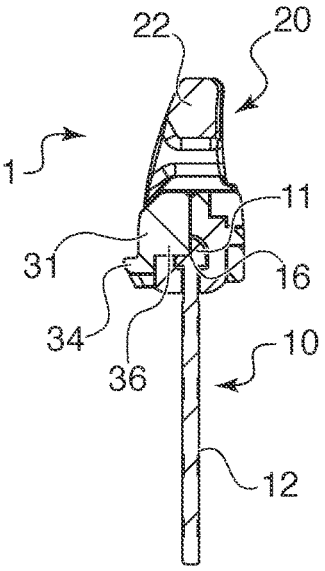
FIG. 11 shows a side cross-sectional view of the connector assembly along lines XI-XI of FIG. 9.
Figure 12:
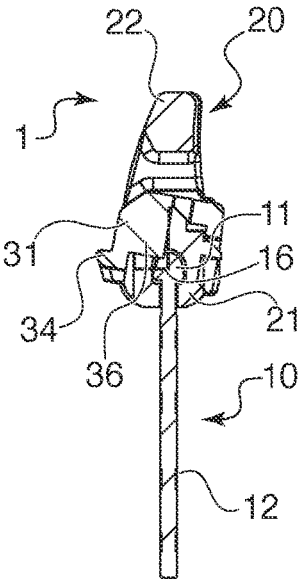
FIG. 12 shows the view of FIG. 11 as the front of the cover assembly is lifted to release the locking teeth.

The position of post 11 in channel 23 can be seen in cross-section in FIGS. 10 and 11. As shown in FIG. 11, locking tooth 36 rests securely in indentation 16 (and locking tooth 35 rests in indentation 15 on the other end) to prevent sliding of the post in either direction. In order to allow male portion 10 to be removed from female portion 20, the user presses upward on flange 34 of cover 30, which, as shown in FIG. 12, causes cover 30 to bend slightly and moves locking teeth 35, 36, out of indentations 15, 16. At this point, post 11 can be slid out of channel 23 in the direction opposite to the arrows shown in FIG. 8. Thus, the parts can be connected together in a single step, but two separate and simultaneous actions, i.e., lifting cover 30 and sliding post 11, are required for disengagement.

Accordingly, while only a few embodiments of the present invention have been shown and described, it is obvious that many changes and modifications may be made thereunto without departing from the spirit and scope of the invention.

What is claimed is:

1. A connector assembly comprising:

a female portion having a base body having a longitudinal channel with an opening along one side of the base body, wherein the longitudinal channel has a width that is greater than a width of the opening, and wherein the base body has at least one slot that extends through to the longitudinal channel in an area remote from the opening;

a male portion having a locking post extending along one longitudinal edge, the locking post having a width that is greater than a width of the opening in the channel and having at least one indentation that aligns with the slot when the post is inserted into the channel, and a locking cover connected to the female portion, the locking cover having an underside that surrounds at least a portion of an outer surface of the base body of the female portion and having at least one locking tooth that extends through the at least one slot and into the channel, wherein the male portion is connected to the female portion by sliding the locking post into the channel until the at least one indentation aligns with the at least one slot, at which point the at least one locking tooth of the locking cover rests in the at least one indentation to prevent movement of the post in the channel, and wherein the male portion is released from the female portion by pulling the locking cover away from the female portion until the at least one locking tooth on the locking cover clears the at least one indentation in the post of the male portion, and sliding the male portion and female portion away from each other.

2. The connector assembly according to claim 1, wherein there are two locking teeth in the locking cover, two slots in the female portion, and two indentations in the post.

3. The connector assembly according to claim 1, wherein the male portion further comprises an attachment tab connected to the post and being configured for being sewn to an article.

4. The connector assembly according to claim 1, wherein the female portion further comprises a strap retaining bar connected to the base body and being configured for attachment to a length of webbing.

5. The connector assembly according to claim 1, wherein the locking cover comprises a front wall, a top wall and a rear wall, wherein female portion has a plurality of studs on a top side and a rear side, and the locking cover has a plurality of sockets extending through the top wall and rear wall, wherein the at least one locking tooth is attached to an interior surface of the front wall, and wherein the locking cover is connected to the female portion by snapping the studs into the sockets, such that the front wall of the locking cover is not attached to the female portion.

6. The connector assembly according to claim 5, wherein the locking cover has a ledge on the front wall that forms a lifting surface for a finger to lift the front wall up and away from the female portion.

7. The connector assembly according to claim 1, wherein a front end of the post is rounded so that when the post is inserted into the channel, the at least one locking tooth slides along the rounded end and is raised up and away from the post to allow the post to be fully inserted into the channel.

8. The connector assembly according to claim 1, wherein a rear end of the post has a flange that is wider than the channel, and a corresponding end of the female portion has a cutout extending into the channel, such that when the post is fully inserted into the channel, the flange is seated in the cutout and prevents further insertion of the post into the channel.

9. The connector assembly according to claim 1, wherein the locking cover is formed at least partially from a flexible material.

* * * * *